US006816122B2

(12) United States Patent
Noro et al.

(10) Patent No.: US 6,816,122 B2
(45) Date of Patent: Nov. 9, 2004

(54) FOUR-POINT FEEDING LOOP ANTENNA CAPABLE OF EASILY OBTAINING AN IMPEDANCE MATCH

(75) Inventors: Junichi Noro, Akita (JP); Masaaki Miyata, Atsugi (JP); Isao Fukae, Chofu (JP); Akira Miyoshi, Hachiouji (JP); Toshihiko Inaba, Akita (JP); Kenichi Taguchi, Akita (JP); Takashi Horikawa, Takamatsu (JP); Wataru Sakaguchi, Kagawa (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/352,620

(22) Filed: Jan. 28, 2003

(65) Prior Publication Data

US 2003/0174098 A1 Sep. 18, 2003

(30) Foreign Application Priority Data

| | | |
|---|---|---|
| Jan. 29, 2002 | (JP) | 2002-020097 |
| Mar. 14, 2002 | (JP) | 2002-070097 |
| Mar. 28, 2002 | (JP) | 2002-091512 |
| Mar. 29, 2002 | (JP) | 2002-093843 |

(51) Int. Cl.[7] ..... H01Q 11/12
(52) U.S. Cl. ..... 343/743; 343/700 MS; 343/866

(58) Field of Search ..... 343/700 MS, 741–744, 343/866

(56) References Cited

U.S. PATENT DOCUMENTS

| | | | | |
|---|---|---|---|---|
| 2,490,815 A | * | 12/1949 | Kandoian | 343/743 |
| 5,134,422 A | * | 7/1992 | Auriol | 343/895 |
| 5,523,761 A | * | 6/1996 | Gildea | 342/357.03 |
| 5,945,959 A | * | 8/1999 | Tanidokoro et al. | 343/728 |
| 6,515,632 B1 | * | 2/2003 | McLean | 343/741 |
| 6,559,804 B2 | * | 5/2003 | Nakano et al. | 343/743 |
| 6,563,469 B2 | * | 5/2003 | Miyata et al. | 343/743 |

* cited by examiner

*Primary Examiner*—Shih-Chao Chen
(74) *Attorney, Agent, or Firm*—Frishauf, Holtz, Goodman & Chick, P.C.

(57) ABSTRACT

In an electromagnetic coupling type four-point feeding loop antenna (10) comprising a tubular body (11), a loop portion (12) having a loop width ($W_1$), four feeders (13) each having a feeder width ($W_2$), and four electromagnetic coupling wires (17) each having a coupling wire width ($W_3$), the loop width, the feeder width, and the coupling wire width are substantially equal to one another. A gap (δ) between the feeder and the electromagnetic coupling wire is laid in a range between 0.2 mm and 0.8 mm, both inclusive, when the electromagnetic coupling type four-point feeding loop antenna has a feeding impedance of a range between 25 Ω and 100 Ω, both inclusive.

9 Claims, 12 Drawing Sheets

FOUR-POINT FEEDING LOOP ANTENNA CAPABLE OF EASILY OBTAINING AN IMPEDANCE MATCH

This application claims priority to prior application JP 2002-20097, JP 2002-70097, JP 2002-91512, and JP 2002-93843, the disclosures of which are incorporated herein by reference.

BACKGROUND OF THE INVENTION

This invention relates to a digital radio receiver for receiving an electric wave from an artificial satellite (that may be called a "satellite wave") or an electric wave on the ground (that may be called a "terrestrial wave") to listen in a digital radio broadcasting and, in particular, to a loop antenna for use in the digital radio receiver.

In recent years, a digital radio receiver, which receives the satellite wave or the terrestrial wave to listen in the digital radio broadcasting, has been developed and is put to practical use in the United States of America. The digital radio receiver is mounted on a mobile station such as an automobile and can receive an electric wave having a frequency of about 2.338 gigaheltz (GHz) to listen in a radio broadcasting. That is, the digital radio receiver is a radio receiver which can listen in a mobile broadcasting. In addition, the terrestrial wave is an electric wave in which a signal where the satellite wave received in an earth station is frequently shifted a little. It is noted that the satellite wave is circular polarization while the terrestrial wave is linear polarization.

In order to receive such an electric wave having the frequency of about 2.338 GHz, it is necessary to set up an antenna outside the automobile. Although such antennas have been proposed those having various structures, the antennas of cylindrical-type are generally used rather than those of planer-type (plane-type). It is possible to obtain a wider directivity by making a shape of the antenna cylindrical.

A loop antenna is known in the art as one of the antennas of the cylindrical-type. The loop antenna has structure where one antenna lead member is wound around a peripheral surface of a hollow or solid cylindrical (which is collectively called "cylindrical") member in a loop fashion, namely, is an antenna having the form of a loop. The cylindrical member may be merely called a "bobbin" or a "dielectric core" in the art. In addition, the antenna lead member may be merely called a "lead." It is known in the art that the loop antenna acts as an antenna having a directivity in a longitudinal direction thereof if the antenna lead member has an all around length which is selected to about one wavelength. This is because the antenna lead member has a sinusoidal distribution of a current. The loop antenna is for receiving the circular polarization or the satellite wave. That is, the loop antenna is used as a satellite wave antenna.

Although it is necessary for the loop antenna to feed to it, a four-point feeding is generally adopted to the loop antenna. In order to receive circular polarization, feeding is carried out at four points having a phase difference of 90 degrees. The loop antenna with the four-point feeding is called in the art a four-point feeding loop antenna. In an existing four-point feeding loop antenna, a feeding is directly carried out to a loop portion.

More specifically, the existing four-point feeding loop antenna comprises a cylindrical body formed by rounding a flexible insulation film around a central axis in a cylindrical fashion, a loop portion made of conductor that is formed on the cylindrical body along a peripheral surface thereof around the central axis in a loop fashion, and four feeders formed on the peripheral surface of the cylindrical body to feed the loop portion at four points. The loop portion is directly connected with each of the four feeders. Such a four-point feeding loop antenna is called a directly coupling type four-point feeding loop antenna.

After the electric wave is received by the loop portion as a received wave, the received wave is divided through the four feeders into four partial received waves which are phase shifted and combined by a phase shifter so as to match phases of the four partial received waves to obtain a combined wave, and then the combined wave is amplified by a low-noise amplifier (LNA) to obtain an amplified wave which is delivered to a receiver body. A combination of the four-point feeding loop antenna, the phase shifter, and the low-noise amplifier is called an antenna device.

In the manner which is described above, inasmuch as the existing four-point feeding loop antenna directly feeds the loop portion from the four feeders, the existing four-point feeding loop antenna is disadvantageous in that it has a too high feeding impedance. Thus, the existing four-point feeding loop antenna is disadvantageous in that it is difficult to obtain an impedance match.

In addition, a monopole antenna is for receiving the linear polarization or the terrestrial wave. That is, the monopole antenna is used as a terrestrial wave antenna. A combination of the loop (or satellite wave) antenna and the monopole (or terrestrial wave) antenna is called a composite antenna. In order to receive both of the satellite wave and the terrestrial wave, an antenna unit including the composite antenna is used. The antenna unit further comprises a shield case mounting the loop antenna and the monopole antenna thereon, top and bottom covers for covering the loop antenna, the monopole antenna, and the shield case. In order to connect the antenna unit with a receiver body, a twin cable is used. The twin cable is connected to the shield case through a bushing sandwiched between the top cover and the bottom cover. The twin cable consists of a first cable for the loop antenna or the satellite wave and a second cable for the monopole antenna or the terrestrial wave. The first cable has a first connector at a tip thereof while the second cable has a second connector at a tip thereof.

On the other hands, the receiver body has a first receptacle for the satellite wave and a second receptacle for the terrestrial wave. Accordingly, the first and the second connectors must be connected to the first and the second receptacles, respectively. It is therefore necessary to distinguish between the first cable and the second cable.

SUMMARY OF THE INVENTION

It is therefore an object of the present invention to provide a four-point feeding loop antenna which is capable of easily obtaining an impedance match.

It is another object of the present invention to provide a four-point feeding loop antenna which is capable of widening an adjustment range of impedance and a frequency characteristic thereof.

It is still another object of the present invention to provide a four-point feeding loop antenna which has a high antenna gain.

It is yet another object of the present invention to provide an antenna unit comprising a twin cable which is capable of certainly distinguishing between a first cable for a satellite wave and a second cable for a terrestrial wave.

Other objects of this invention will become clear as the description proceeds.

According to a first aspect of this invention, an electromagnetic coupling type four-point feeding loop antenna comprises a tubular body formed by rounding a flexible insulator film member around a central axis in a tubular fashion. The tubular body has a peripheral surface. Made of conductor, a loop portion is formed on the tubular body along the peripheral surface around the central axis in a loop fashion. The loop portion has a loop width. Four feeders are formed on the peripheral surface of the tubular body to feed to the loop portion at four points. Each of the four feeders has a feeder width. Connected to the loop portion, four electromagnetic coupling wires extend on the flexible insulator film member from the loop portion along the four feeders with gaps left between the four feeders and the four electromagnetic coupling wires, respectively. Each of the four electromagnetic coupling wires has a coupling wire width. The loop width, the feeder width, and the coupling wire width are substantially equal to one another. Each of the gaps is laid in a range between 0.2 mm and 0.8 mm, both inclusive, when the electromagnetic coupling type four-point feeding loop antenna has a feeding impedance of a range between 25 Ω and 100 Ω, both inclusive.

According to a second aspect of this invention, an electromagnetic coupling type four-point feeding loop antenna comprises a tubular body formed by rounding a flexible insulator film member around a central axis in a tubular fashion. The tubular body has a peripheral surface. A loop portion made of conductor is formed on the tubular body along the peripheral surface around the central axis in a loop fashion. Four feeders are formed on the peripheral surface of the tubular body to feed to the loop portion at four points. Four pairs of electromagnetic coupling wires are connected to the loop portion. Each pair of electromagnetic coupling wires extends on the flexible insulator film member from the loop portion along one of the four feeders with gaps so as to put the one of the four feeders between the pair of electromagnetic coupling wires.

According to a third aspect of this invention, a four-point feeding loop antenna comprises a tubular body formed by rounding a flexible insulator film member around a central axis in a tubular fashion. The tubular body has a peripheral surface. A loop portion made of conductor is formed on the tubular body along the peripheral surface around the central axis in a loop fashion. The loop portion has four bending portions each of which is bent towards a feeding source. Four feeders are formed on the peripheral surface of the tubular body to feed to the loop portion at four points.

According to a fourth aspect of this invention, an antenna unit comprises a satellite wave antenna for receiving a satellite wave, a terrestrial wave antenna for receiving a terrestrial wave, and a shield case mounting the satellite wave antenna and the terrestrial wave antenna thereon. Top and bottom covers are for covering the satellite wave antenna, the terrestrial wave antenna, and the shield case. A twin cable is connected to the shield case through a bushing sandwiched between the top cover and the bottom cover. The twin cable comprises a first cable for the satellite wave antenna and a second cable for the terrestrial wave antenna. The first and the second cables have first and second outer coats, respectively. At least one of the first and the second outer coats has marking formed thereon to allow to distinguish between the first cable and the second cable.

DESCRIPTION OF THE PREFERRED EMBODIMENT

Referring to FIGS. 1A, 1B, 2, and 3, the description will proceed to an electromagnetic coupling type four-point feeding loop antenna 10 according to a first embodiment of this invention. The illustrated electromagnetic coupling type four-point feeding loop antenna 10 has a central axis O and comprises a tubular body 11, a loop portion 12, four feeders 13. In the example being illustrated, the tubular body 11 is a cylindrical body.

The tubular body 11 is formed by rounding a flexible insulator film member (which will later be described) around the central axis O in a tubular fashion in the manner which will later be described. The loop portion 12 is made of conductor and is formed on the tubular body 11 along a peripheral surface thereof around the central axis O in a loop fashion. The four feeders 13 are formed on the peripheral surface of the tubular body 11 to feed to the loop portion 12 at four points. As the conductor of the loop portion 12, for example, copper foil may be used. In addition, as the flexible insulator film member for use in the tubular body 11, for example, plastic such as polyimide resin is used. In the example being illustrated, the tubular body 11 has a diameter of 20 mm.

According to this invention, the electromagnetic coupling type four-point feeding loop antenna 10 has gaps δ between the loop portion 12 and the four feeders 13 to feed to the loop portion 12 by electromagnetic coupling. In the example being illustrated, each gap δ is equal to, for example, 0.4 mm and preferably may lie in a range of 0.2–0.8 mm.

Figure 1A:
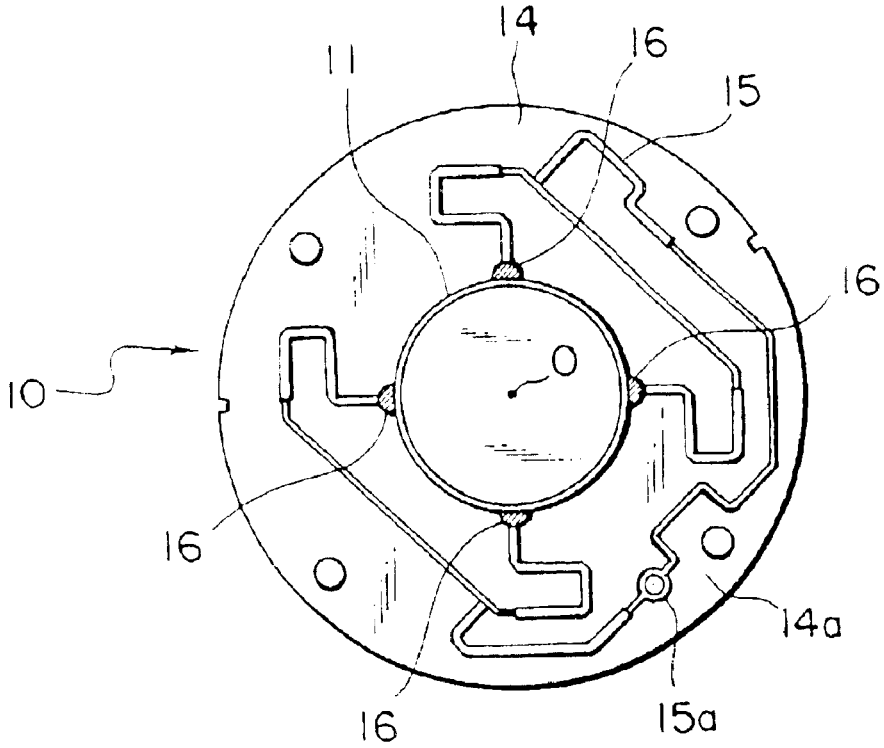
FIG. 1A is a plan view showing an electromagnetic coupling type four-point feeding loop antenna according to a first embodiment of this invention.
Figure 1B:
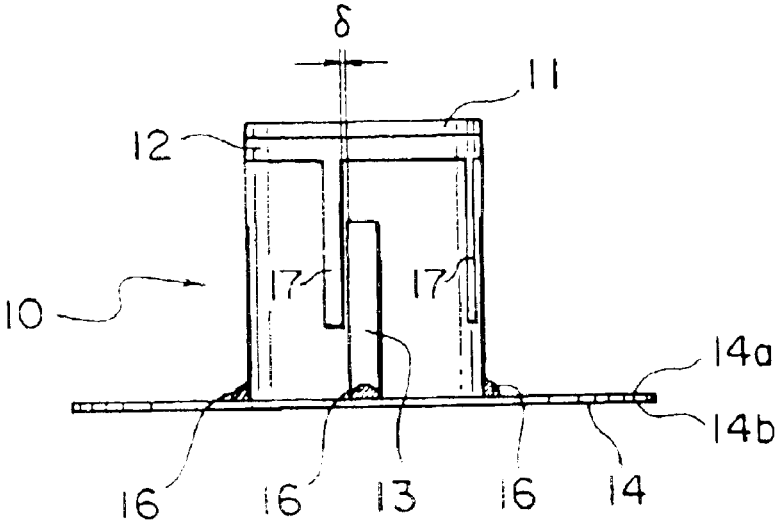
FIG. 1B is a front view of the electromagnetic coupling type four-point feeding loop antenna illustrated in FIG. 1A.
Figure 2:
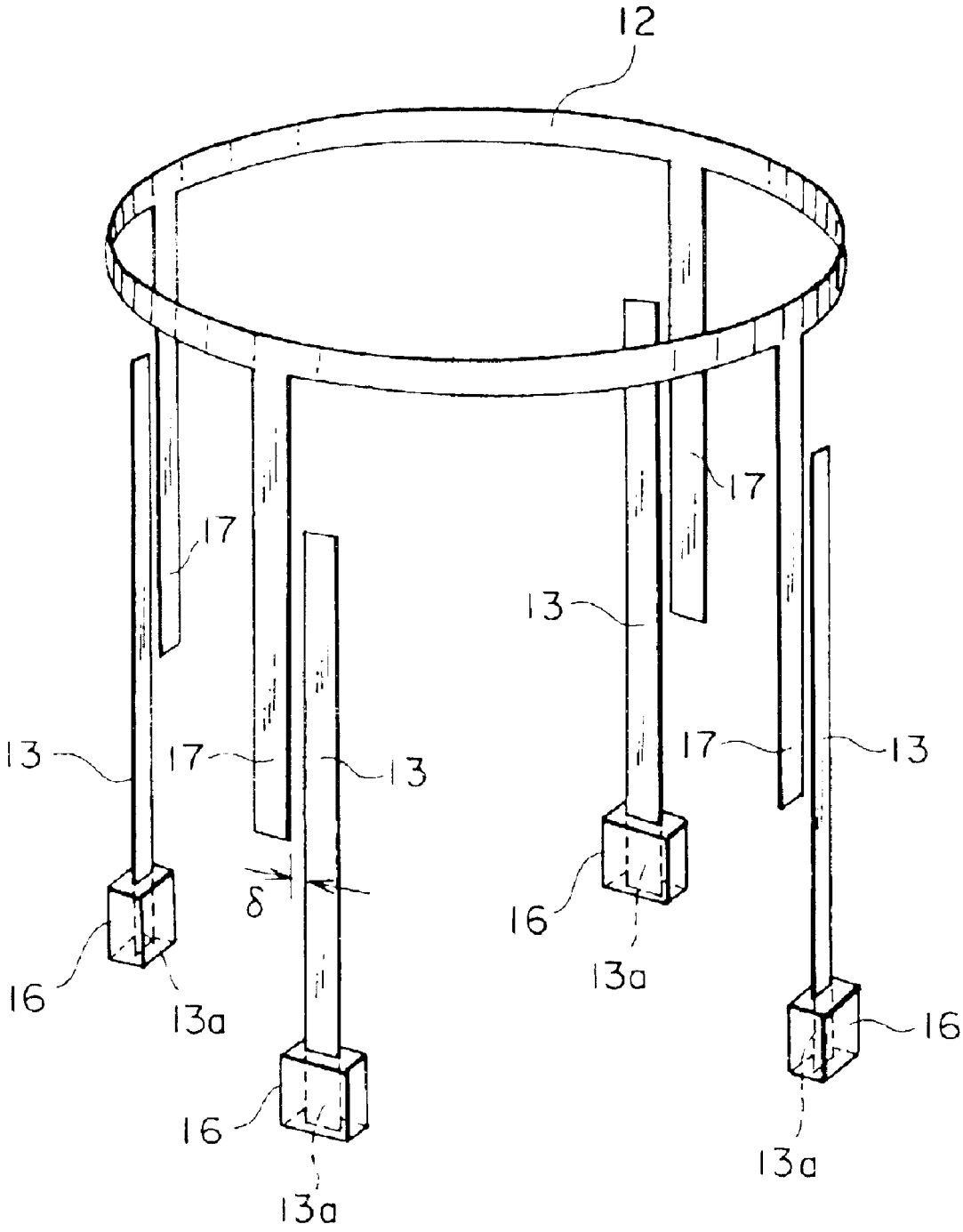
FIG. 2 is a perspective view showing an arrangement relationship between a loop portion and four feeders which constitute the electromagnetic coupling type four-point feeding loop antenna illustrated in FIGS. 1A and 1B.

As shown in FIGS. 1A and 1B, the tubular body 11 has a longitudinal lower end which is fixed on a circuit board 14. The circuit board 14 has a main surface 14*a* on which a phase shifter 15 is formed. The circuit board 14 has a back surface 14*b* on which a ground conductive pattern (not shown) is formed. In addition, the four feeders 13 have four feeding terminals 13*a* (FIG. 2) which are electrically and mechanically connected to input terminals of the phase shifter 15 using solder 16.

Figure 3:
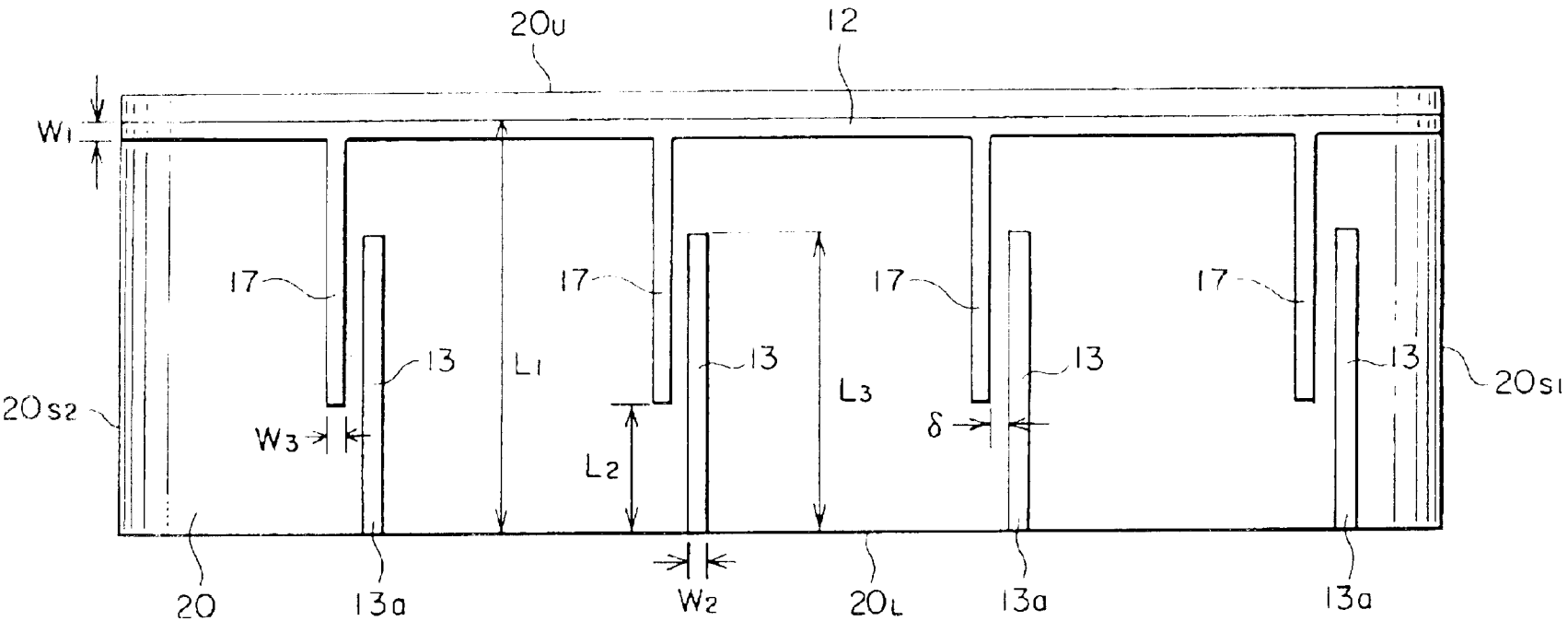
FIG. 3 is development of the electromagnetic coupling type four-point feeding loop antenna illustrated in FIGS. 1A and 1B.

Referring to FIG. 3, the flexible insulator film member 20 for use in forming the tubular body 11 substantially has a rectangular shape which has an upper side $\mathbf{20}_U$, a lower side $\mathbf{20}_L$, a first lateral side $\mathbf{20}_{S1}$, and a second lateral side $\mathbf{20}_{S2}$. By connecting the first lateral side $\mathbf{20}_{S1}$ with the second lateral side $\mathbf{20}_{S2}$, the tubular body 11 is formed as shown in FIGS. 1A and 1B. This connection between the first lateral side $\mathbf{20}_{S1}$ and the second lateral side $\mathbf{20}_{S2}$ is carried out, for example, by using double-sided adhesive tape or an adhesive agent.

In addition, the loop portion 12 is formed on one surface of the flexible insulator film member 20 in the vicinity of the upper side $\mathbf{20}_U$. While the tubular body 11 is formed by rounding the flexible insulator film member 20, both ends of the loop portion 12 are electrically connected to each other.

In the electromagnetic coupling type four-point feeding loop antenna 10, each of the four feeders 13 extends in parallel with the central axis O from the lower side $\mathbf{20}_L$ and the vicinity of the loop portion 12. In addition, the loop portion 12 is connected with four electromagnetic coupling wires 17 which extend from the loop portion 12 toward the lower side $\mathbf{20}_L$ along the four feeders 13 with the gaps δ left between the four feeders 13 and the four electromagnetic coupling wires 17, respectively. By changing a coupling length L between the feeder 13 and the electromagnetic coupling wire 17 which are adjacent to each other, it is possible to change a frequency characteristic of the electromagnetic coupling type four-point feeding loop antenna 10.

Formed on the one surface of the flexible insulator film member 20, the loop portion 12, the four feeders 13, and the four electromagnetic coupling wires 17 may be made of the conductive material (e.g. copper file).

In general, it is necessary in a four-point feeding loop antenna to make a feeding impedance thereof 50 Ω. In the electromagnetic coupling type four-point feeding loop antenna 10 according to the first embodiment of this invention, it is possible to lower an impedance at each feeding terminal 13*a* up to 25 Ω. Accordingly, it is possible to make an impedance at an output terminal 15*a* of the phase shifter 15 a range between 50 Ω and 100 Ω, both inclusive. That is, by feeding to the loop portion 12 by electromagnetic coupling, it is possible to easily obtain the impedance match. In addition, it is possible to change the impedance at each feeding terminal 13*a* by changing a size of each gap δ.

On the contrary, in an existing four-point feeding loop antenna having structure where each feeder 13 is directly connected to the loop portion 12, each feeding terminal 13*a* has a too high impedance of a range between 250 Ω and 300 Ω. As a result, it is difficult to obtain impedance match at the output terminal 15*a* of the phase shifter 15.

Now, the description will proceed to position relationship among the loop portion 12, the four feeders 13, the gaps δ, and the four electromagnetic coupling wires 17 with concrete sizes.

Referring to FIG. 3, it will be assumed for the electromagnetic coupling type four-point feeding loop antenna 10 that the tubular body 11 has a diameter of 20 mm, the loop portion 12 has a loop width of $W_1$, each feeder 13 has a feeder width of $W_2$, and each electromagnetic coupling wire 17 has a coupling wire width of $W_3$ in which the loop width $W_1$, the feeder width $W_2$, and the coupling wire width $W_3$ are equal to one another. In this event, each of gaps δ is laid in a range between 0.2 mm and 0.8 mm, both inclusive when the feeding impedance at the output terminal 15*a* of the phase shifter 15 has a range between 25 Ω and 100 Ω.

More specifically, it will be assumed for the above-mentioned electromagnetic coupling type four-point feeding loop antenna 10 that the feeding impedance has 25 Ω. In this event, each of the loop width $W_1$, the feeder width $W_2$, and the coupling wire width $W_3$ is equal to 1 mm, each of the gaps δ is equal to 0.4 mm. In addition, an interval $L_1$ between the loop portion 12 and the lower side $\mathbf{20}_L$ is equal to 20 mm, an interval $L_2$ between the lower side 10L and a tip of each of the four electromagnetic coupling wires 17 is equal to 9 mm, and each of the four feeders 13 has a length $L_3$ of 15 mm.

In addition, it will be assumed for the above-mentioned electromagnetic coupling type four-point feeding loop antenna 10 that the feeding impedance has 50 Ω. In this event, each of the loop width $W_1$, the feeder width $W_2$, and the coupling wire width $W_3$ is equal to 1 mm, and each of the gaps δ is equal to 0.4 mm. The interval $L_1$ between the loop portion 12 and the lower side $\mathbf{20}_L$ is equal to 20 mm, the interval $L_2$ between the lower side $\mathbf{20}_L$ and the tip of each of the four electromagnetic coupling wires 17 is equal to 5 mm, and each of the four feeders 13 has the length $L_3$ of 12 mm.

Furthermore, it will be assumed for the above-mentioned electromagnetic coupling type four-point feeding loop antenna 10 that the feeding impedance has 100 Ω. In this event, each of the loop width $W_1$, the feeder width $W_2$, and the coupling wire width $W_3$ is equal to 1 mm and each of the gaps δ is equal to 0.4 mm. The interval $L_1$ between the loop portion 12 and the lower side $\mathbf{20}_L$ is equal to 20 mm, the interval $L_2$ between the lower side $\mathbf{20}_L$ and a tip of each of the four electromagnetic coupling wires 17 is equal to 3 mm, and each of the four feeders 13 has the length $L_3$ of 8 mm.

Figure 4A:
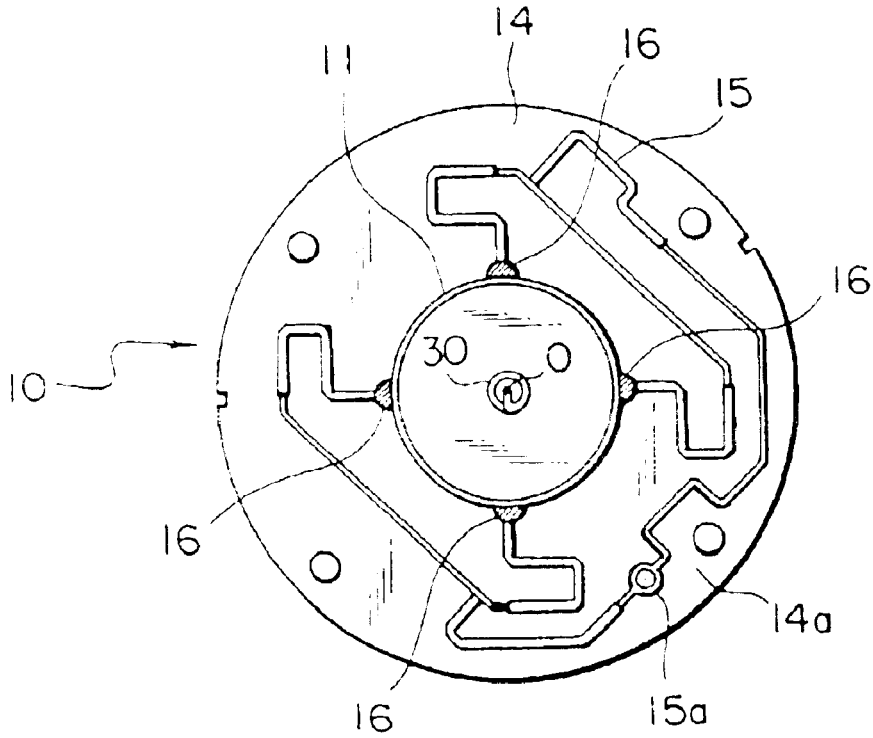
FIG. 4A is a plan view showing a composite antenna including the electromagnetic coupling type four-point feeding loop antenna illustrated in FIGS. 1A and 1B.
Figure 4B:
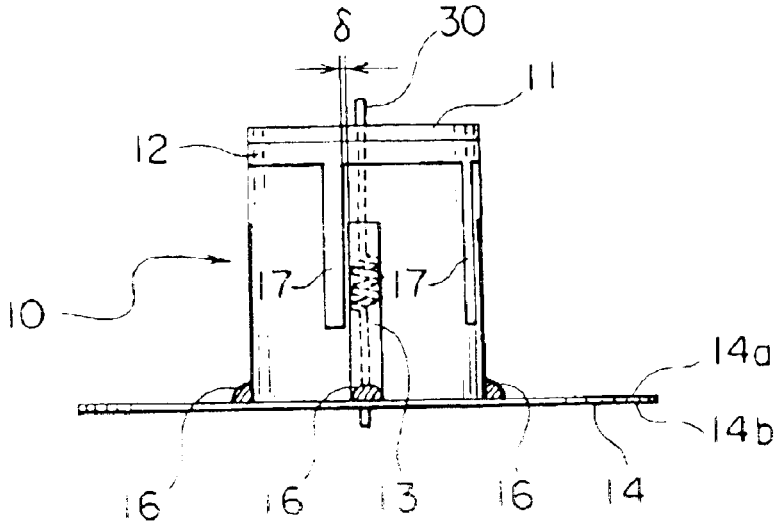
FIG. 4B is a front view of the composite antenna illustrated in FIG. 4A.
Figure 5A:
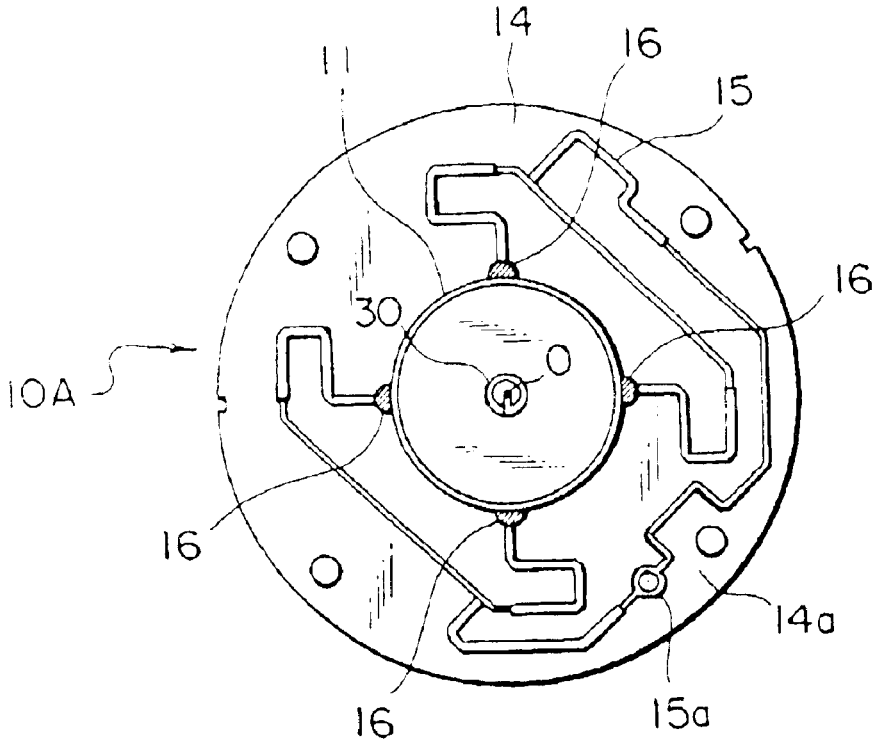
FIG. 5A is a plan view showing a composite antenna including an electromagnetic coupling type four-point feeding loop antenna according to a second embodiment of this invention.
Figure 5B:
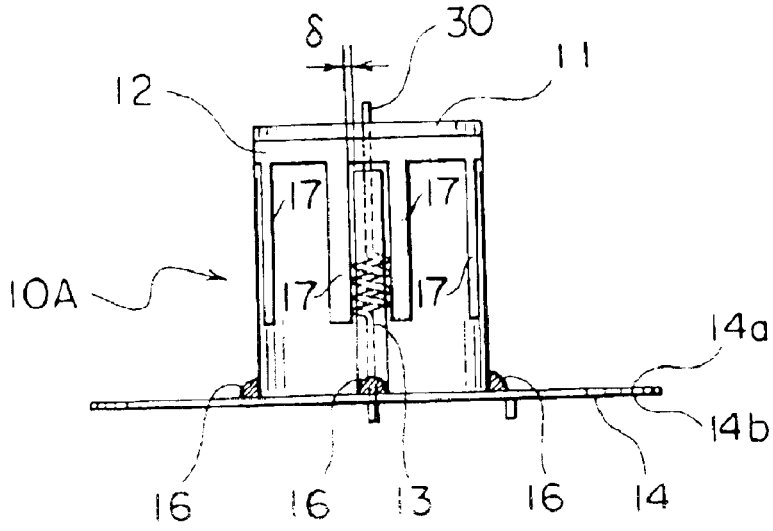
FIG. 5B is a front view of the composite antenna illustrated in FIG. 5A.
Figure 6:
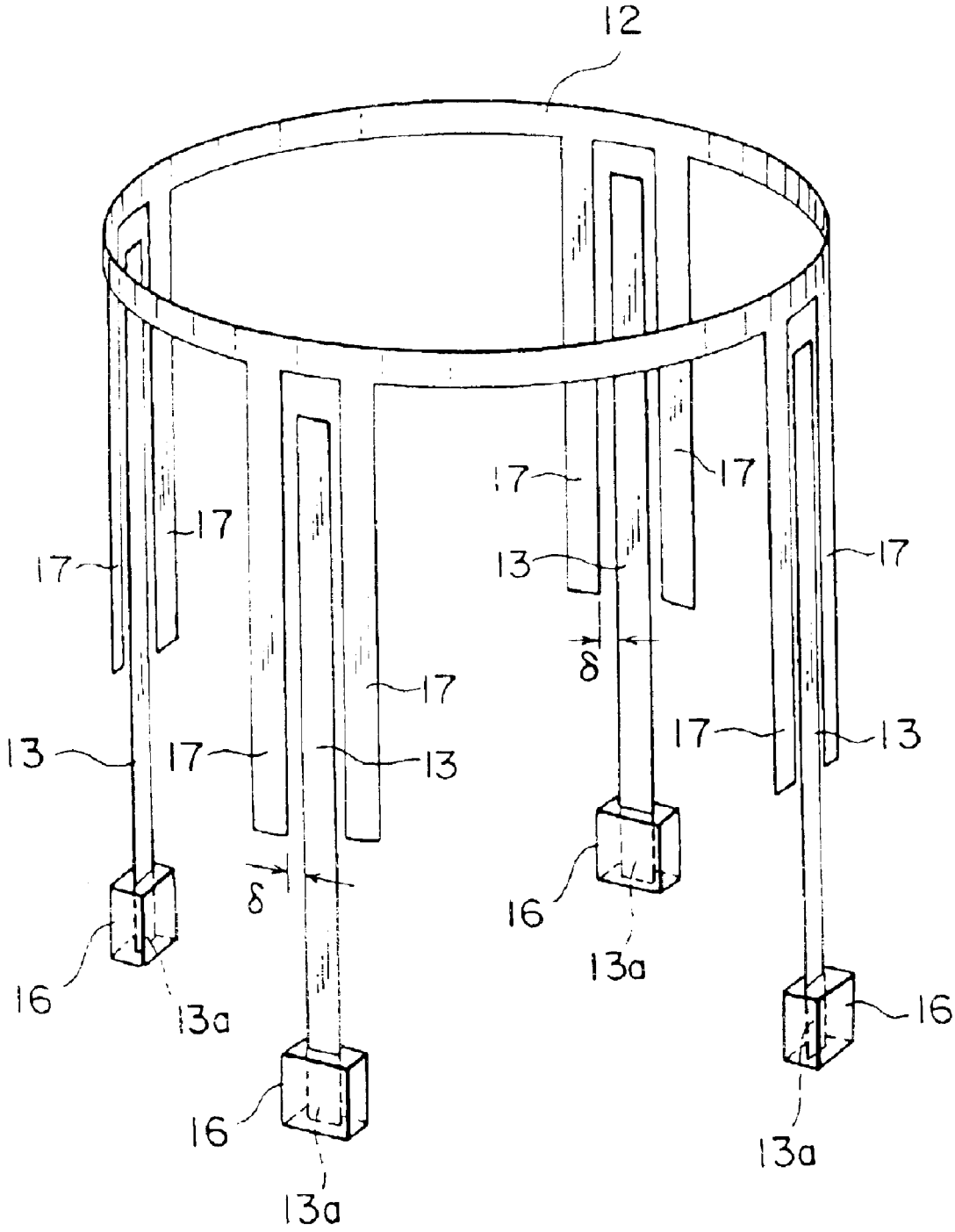
FIG. 6 is a perspective view showing an arrangement relationship between a loop portion and four feeders which constitute the electromagnetic coupling type four-point feeding loop antenna illustrated in FIGS. 5A and 5B.
Figure 7:
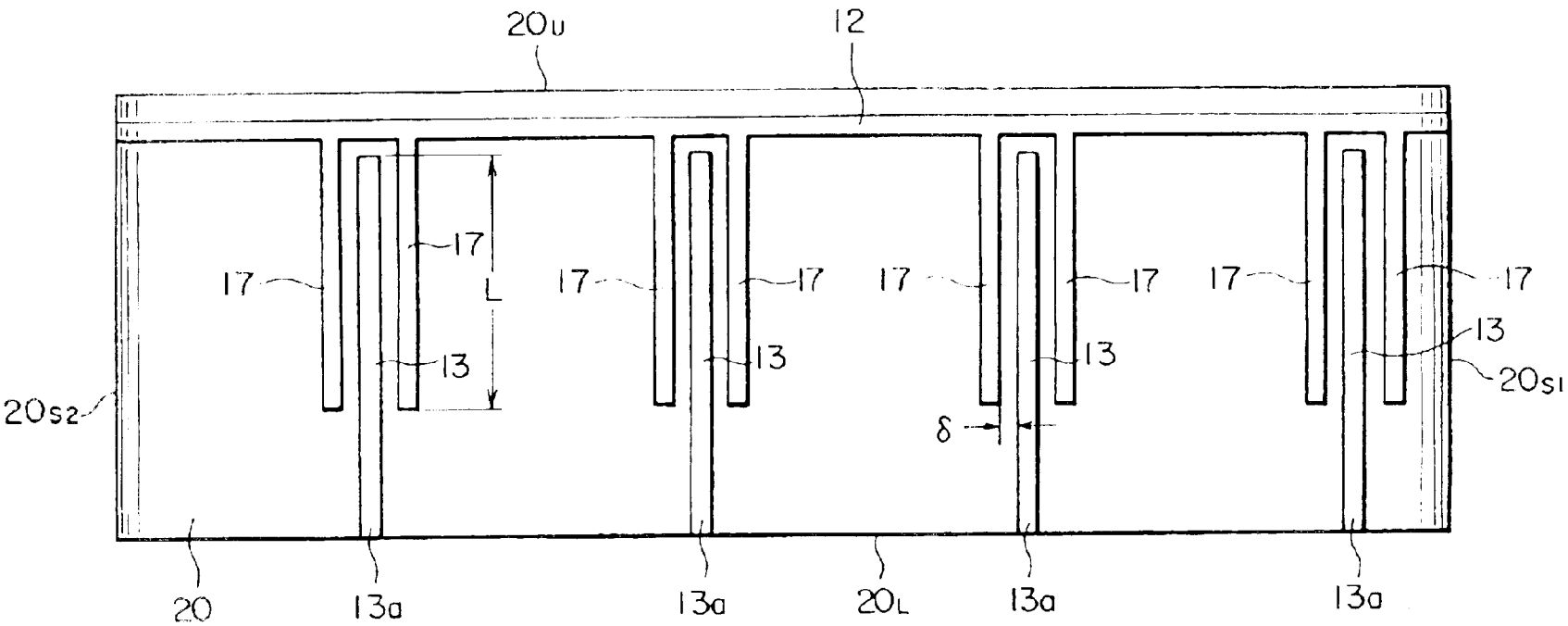
FIG. 7 is development of the electromagnetic coupling type four-point feeding loop antenna illustrated in FIGS. 5A and 5B.
Figure 8A:
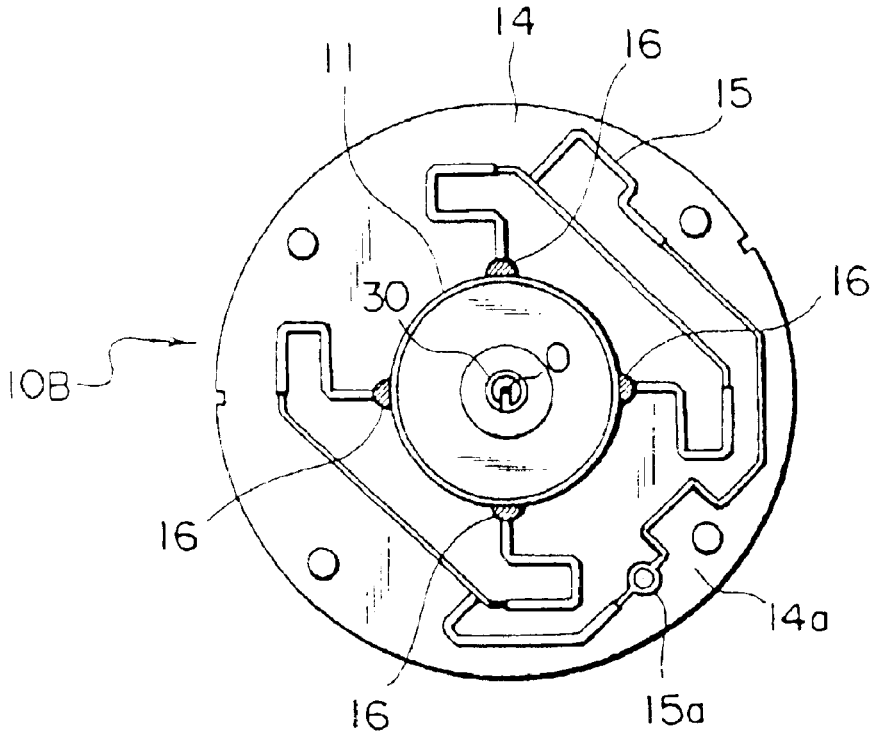
FIG. 8A is a plan view showing a composite antenna including an electromagnetic coupling type four-point feeding loop antenna according to a second embodiment of this invention.
Figure 8B:
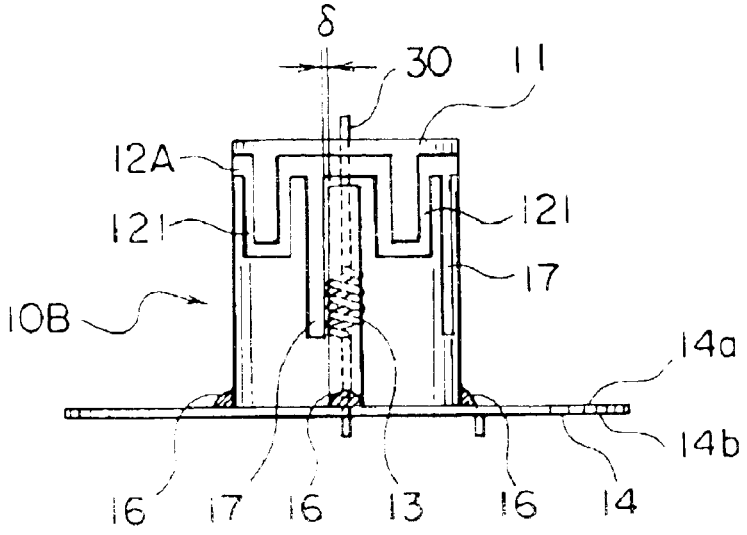
FIG. 8B is a front view of the composite antenna illustrated in FIG. 5A.
Figure 9:
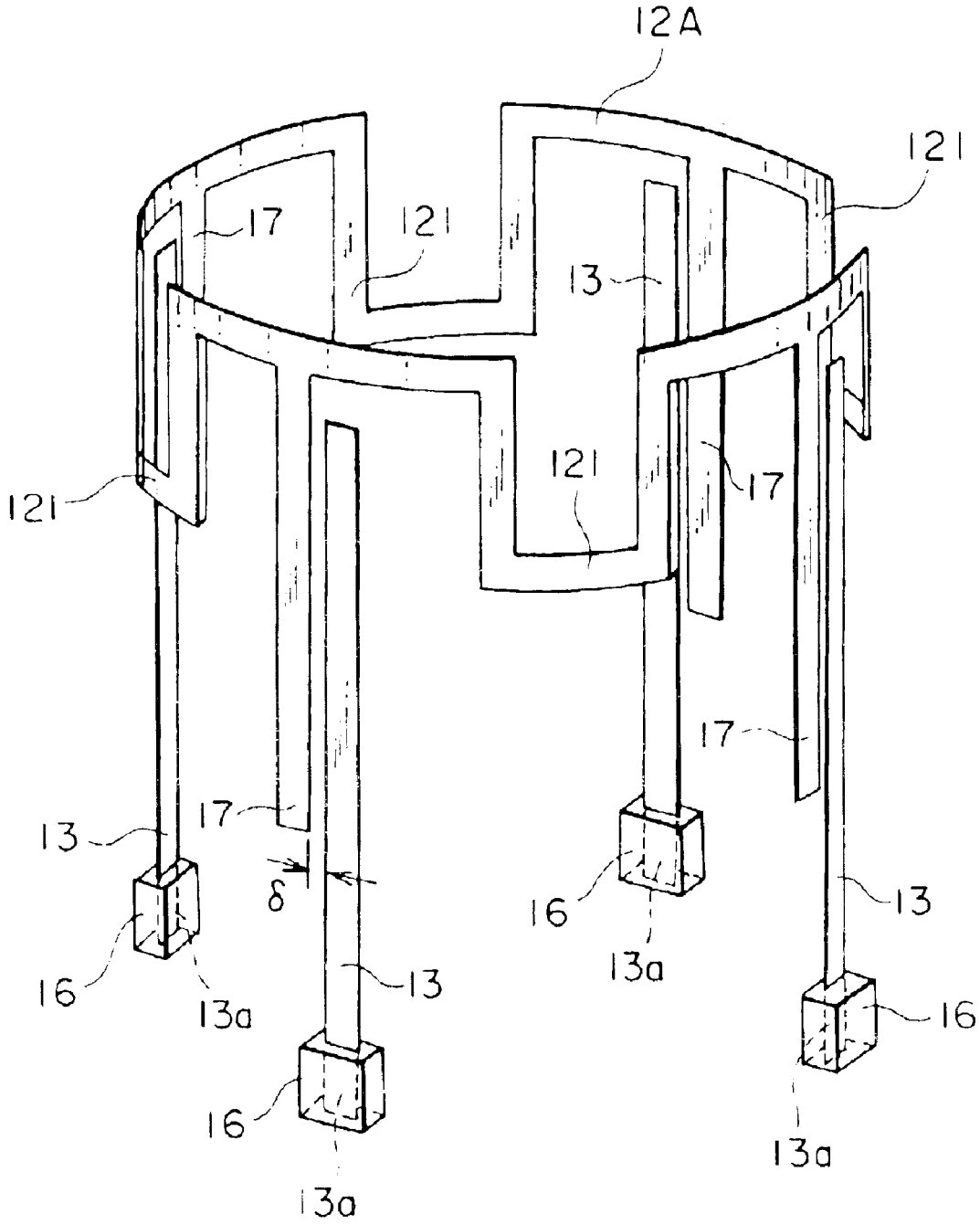
FIG. 9 is a perspective view showing an arrangement relationship between a loop portion and four feeders which constitute the electromagnetic coupling type four-point feeding loop antenna illustrated in FIGS. 8A and 8B.

Referring to FIGS. 4A and 4B, the description will proceed to a composite antenna including the electromagnetic coupling type four-point feeding loop antenna 10. The illustrated composite antenna further comprises a monopole antenna 30. Similar reference symbols are attached to those similar to the electromagnetic coupling type four-point feeding loop antenna 10 in illustrated in FIGS. 1A, 1B, 2, and 3 and description thereof is omitted to simplify description.

With this structure, the electromagnetic coupling type four-point feeding loop antenna 10 can receive the satellite wave or the circular polarization while the monopole antenna 30 can receive the terrestrial wave or the liner polarization.

In the example being illustrated, the monopole antenna 30 is mounted on the circuit board 14 in a direction of the central axis O of the tubular body 11. In the example being illustrated, the monopole antenna 30 has an upper projected length of 1.8 mm.

Referring to FIGS. 5A, 5B, 6, and 7, the description will proceed to a composite antenna including an electromagnetic coupling type four-point feeding loop antenna 10A according to a second embodiment of this invention. The illustrated electromagnetic coupling type four-point feeding loop antenna 10A is similar in structure to that illustrated in FIGS. 1A, 1B, 2, and 3 except that the number of the electromagnetic coupling wires 17 is different from that illustrated in FIGS. 1A, 1B, 2, and 3 in the manner which will later become clear. Similar reference symbols are attached to those similar to the electromagnetic coupling type four-point feeding loop antenna 10 in illustrated in FIGS. 1A, 1B, 2, and 3 and description thereof is omitted to simplify description.

The illustrated electromagnetic coupling type four-point feeding loop antenna 10A comprises eight electromagnetic coupling wires 17 or four pairs of the electromagnetic coupling wires 17. Each pair of electromagnetic coupling wires 17 extends on the flexible insulator film member 20 from the loop portion 12 along a particular one of the four feeders 13 with gaps δ so as to put the particular one of the four feeders 13 between the pair of electromagnetic coupling wires 17 in question. That is, in the example being illustrated, the gaps δ have a shape of a comb. By changing a coupling length L between the feeder 13 and the electromagnetic coupling wire 17 which are adjacent to each other, it is possible to change a frequency characteristic of the electromagnetic coupling type four-point feeding loop antenna 10A. In addition, it is possible to change the impedance at each feeding terminal 13*a* by changing a size of each gap δ.

It is possible for the electromagnetic coupling type four-point feeding loop antenna 10A to widen the gap δ in comparison with the electromagnetic coupling type four-point feeding loop antenna 10. It is generally difficult to process (form) the feeders 13 and the electromagnetic coupling wires 17 so as to maintain narrow gaps δ with high precision.

In other words, in the electromagnetic coupling type four-point feeding loop antenna 10A, it is possible to increase an area of an electromagnetic coupling portion by making the gaps δ comb-shaped and it is possible to widen an adjustment range of the impedance and the frequency characteristic in comparison with the electromagnetic coupling type four-point feeding loop antenna 10.

Referring to FIGS. 8A, 8B, 9, and 10, the description will proceed to a composite antenna including an electromagnetic coupling type four-point feeding loop antenna 10B according to a third embodiment of this invention. The illustrated electromagnetic coupling type four-point feeding loop antenna 10B is similar in structure to that illustrated in FIGS. 1A, 1B, 2, and 3 except that the loop portion is modified from that illustrated in FIGS. 1A, 1B, 2, and 3 in the manner which will later become clear. The loop portion is therefore depicted at 12A. Similar reference symbols are attached to those similar to the electromagnetic coupling type four-point feeding loop antenna 10 in illustrated in FIGS. 1A, 1B, 2, and 3 and description thereof is omitted to simplify description.

Figure 10:
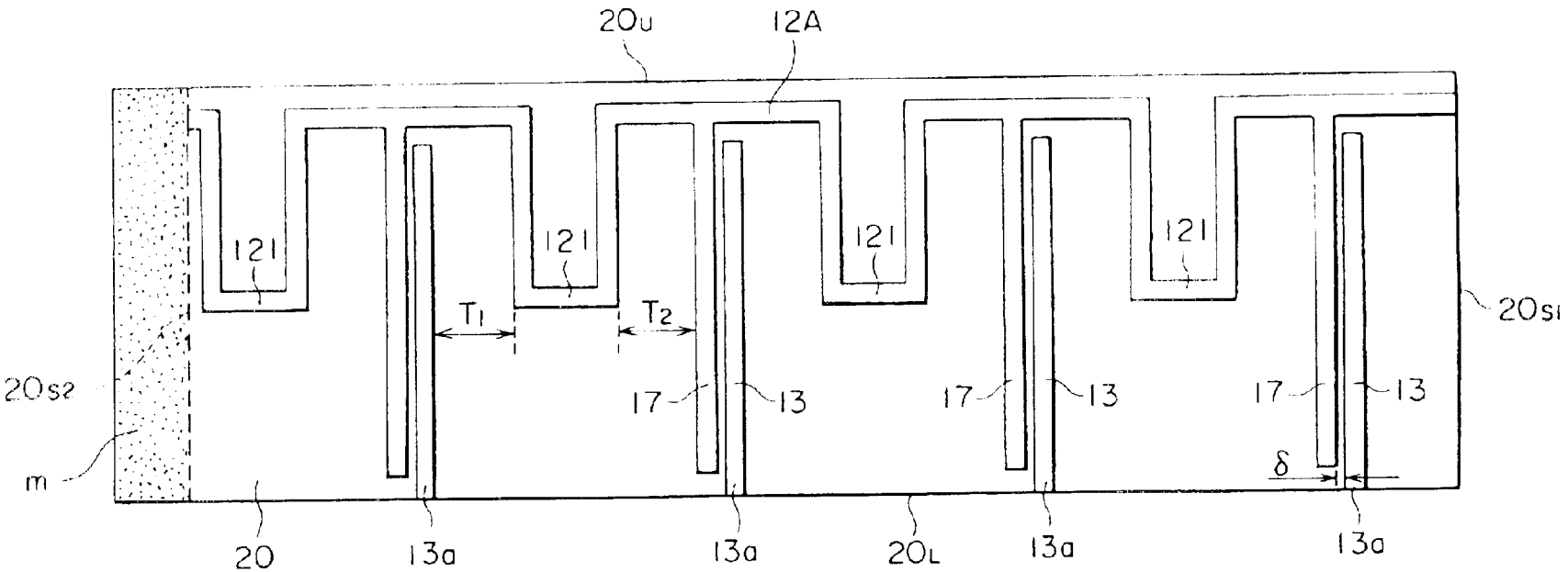
FIG. 10 is development of the electromagnetic coupling type four-point feeding loop antenna illustrated in FIGS. 8A and 8B.

The loop portion 12A has four bending portions 121 each of which is bent towards a feeding source. In the example being illustrated, a space $T_1$ between the feeder 13 and the bending portion 121 is substantially equal to a space $T_2$ between the electromagnetic coupling wire 17 as shown in FIG. 10. In FIG. 10, a reference symbol of m indicates a tab for sticking.

The present co-inventors confirmed that the electromagnetic coupling type four-point feeding loop antenna 10B comprising the tubular body 11 having the diameter of 20 mm has an antenna front gain which is similar to that of the electromagnetic coupling type four-point feeding loop antenna 10 comprising the tubular body 11 having the diameter of 25 mm. It is therefore possible to miniaturize the electromagnetic coupling type four-point feeding loop antenna 10B.

Although the third embodiment of this invention is applied to the electromagnetic coupling type four-point feeding loop antenna 10B, the third embodiment of this invention may be applied to a directly coupling type four-point feeding loop antenna. In addition, although the tubular body 11 is the cylindrical body, the tubular body 11 may be a hollow prismatic body.

Figure 11A:
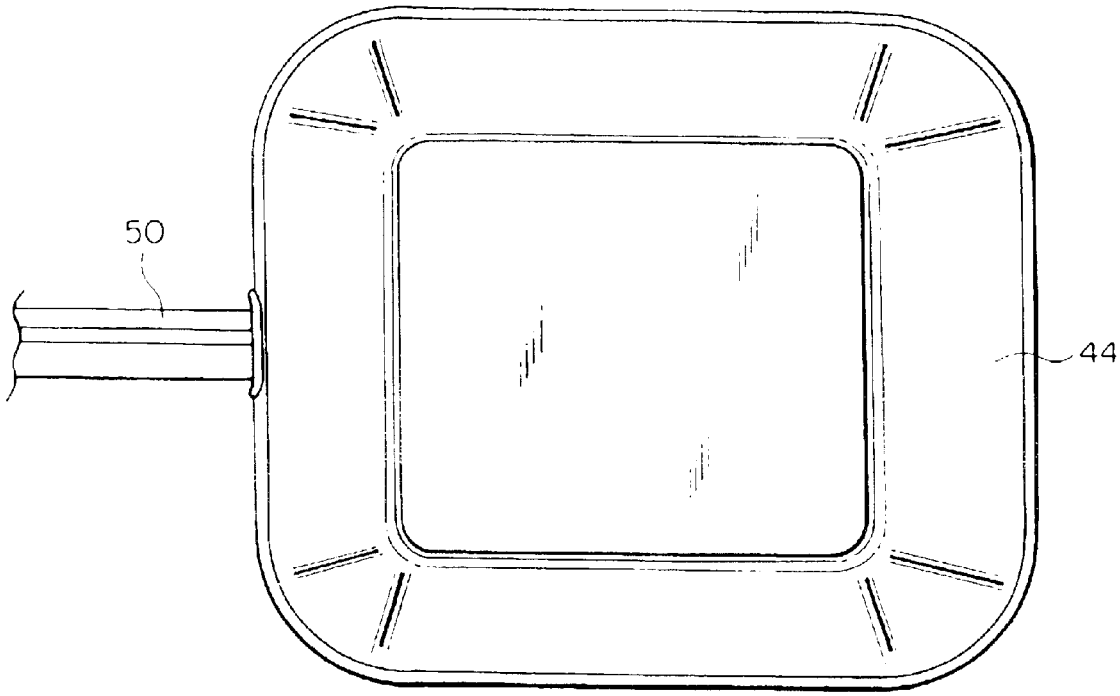
FIG. 11A is a plan view showing an antenna unit including the composite antenna illustrated in FIGS. 4A and 4B.
Figure 11B:
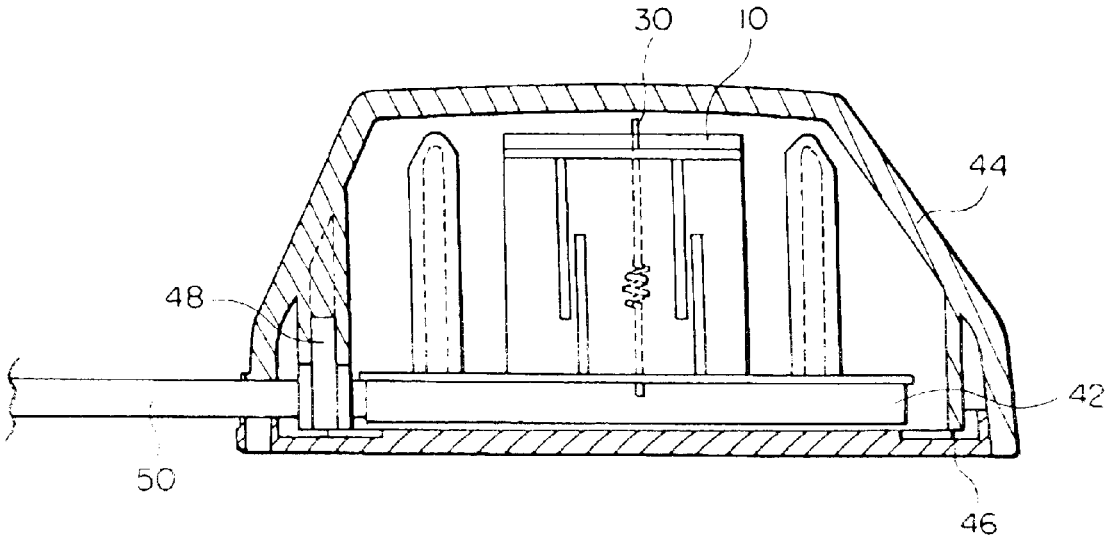
FIG. 11B is an longitudinal sectional view of the antenna unit illustrated in FIG. 11A.

Referring to FIGS. 11A and 11B, the description will proceed to an antenna unit including the composite antenna illustrated in FIGS. 4A and 4B.

The illustrated antenna unit further comprises a shield case 42 mounting the loop antenna 10 and the monopole antenna 30 thereon. Low noise amplifiers (not shown) are received in the shield case 42. A combination of a top cover 44 and a bottom cover 46 is for covering the loop antenna 10, the monopole antenna 30, and the shield case 42. A twin cable 50 is connected to the shielding case 42 through a bushing 48 sandwiched between the top cover 44 and the bottom cover 46. The twin cable 50 is for connecting the loop antenna 10 and the monopole antenna 30 with a receiver body (not shown).

In the manner which is described above, the loop antenna 10 serves as the satellite wave antenna for receiving the satellite wave while the monopole antenna 30 serves as the terrestrial wave antenna for receiving the terrestrial wave.

Figure 12A:
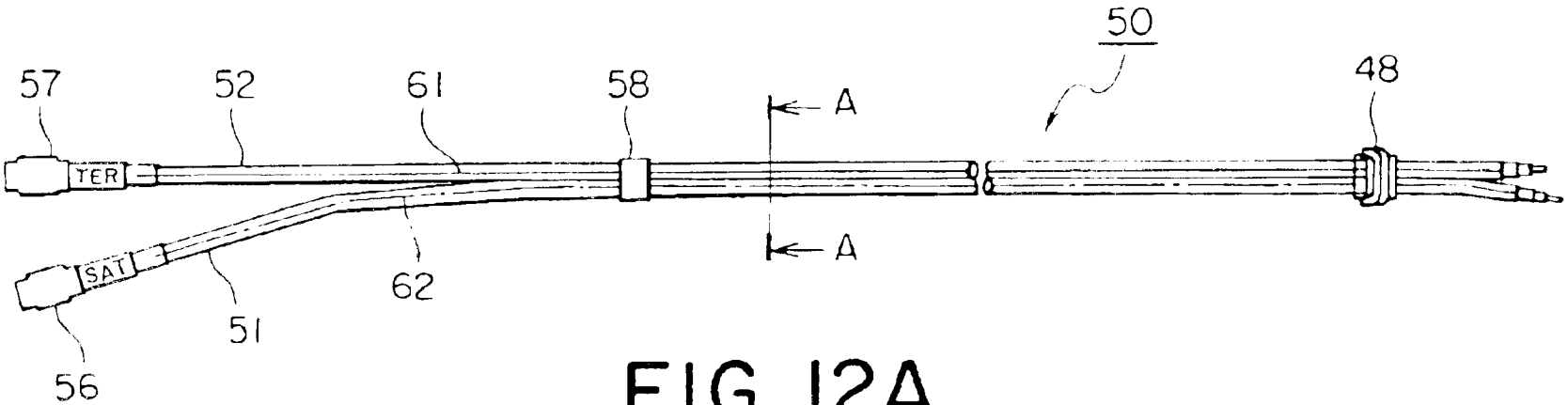
FIG. 12A is a plan view of a twin cable for use in the antenna unit illustrated in FIGS. 11A and 11B.
Figure 12B:
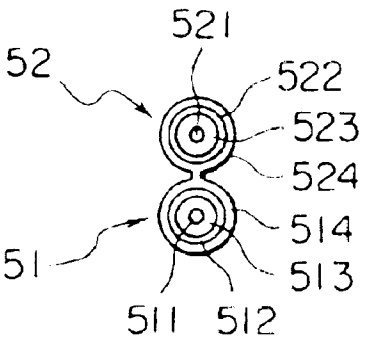
FIG. 12B is a sectional view taken along a line A—A in FIG. 12A.

As shown in FIGS. 12A and 12B, the twin cable 50 comprises a first insulated cable 51 for the loop antenna 10 or the satellite wave and a second insulated cable 52 for the monopole antenna 30 or the terrestrial wave.

As shown in FIG. 12B, the first insulated cable 51 comprises a first inner conductor 511, a first outer conductor 512, a first insulator 513 between the first inner conductor 511 and the first outer conductor 512, and a first outer coat 514 for coating the first outer conductor 512. Likewise, the second insulated cable 52 comprises a second inner conductor 521, a second outer conductor 522, a second insulator 523 between the second inner conductor 521 and the second outer conductor 522, and a second outer coat 524 for coating the second outer conductor 522. The first and the second insulated cables 51 and 52 are in parallel to each other and united in a body in a state that they can be easily separated from each other by hands (or external force). At any rate, the first and the second cables 51 and 52 have the first and the second outer coats 514 and 524 united in a body at a contact part between them.

As regards one end of the twin cable 50, the first and the second insulated cables 51 and 52 are separated from each other to easily connect to two terminals (first and second receptacles), which are distant from each other, of the receiver body. The twin cable 50 has first and second connectors 56 and 57 at tips of the first and the second insulated cables 51 and 52. As shown in FIG. 12A, a split-proof bushing 58 for preventing the first and the second insulated cables 51 and 52 from separating from each other is put on the twin cable 50 at a position apart from the first and the second connectors 56 and 57 by about several centimeters. In addition, the bushing 48 for fixing the twin cable 50 in the antenna unit is put on the twin cable 50 near other ends of the twin cable 50. The split-proof bushing 58 and the bushing 48 may be mounted on the twin cable 50 or may be integrally formed with the first and the second outer coats 514 and 524 of the twin cable 50.

Marking 61 is formed on the second outer coat 524 of the second insulated cable 52 to allow to distinguish between the first insulated cable 51 and the second insulated cable 52. In the example being illustrated, the making 61 comprises a solid line extending in a longitudinal direction along the second insulated cable 52 and has a color different from that of the first and the second outer coats 514 and 524. For example, when the color of the first and the second outer coats 514 and 524 is black, the color of the making 61 may be white.

Although the marking 61 is formed on the second outer coat 524 in the example being illustrated, making may be formed on the first outer coat 514 in lieu of the second outer coat 524. In addition, another making 62 may be further formed on the first outer coat 514 as shown at a dot-dash line in FIG. 12A. In this event, the making 62 formed on the first outer coat 514 and the making 61 formed on the second outer coat 524 have different colors. Alternatively, if the making is carried out by printing, characters such as "for satellite wave" and "for terrestrial wave" may be printed on the first and the second outer coats 514 and 524 at regular intervals along the longitudinal direction of the twin cable 50, respectively.

While this invention has thus far been described in conjunction with a few preferred embodiment thereof, it will now be readily possible for those skilled in the art to put this invention into various other manners. For example, although the feeders 13 and the electromagnetic coupling wires 17 substantially extend a normal direction to the lower side $\mathbf{20}_L$ of the flexible insulator film member 20 in the above-mentioned embodiments, they may substantially extend in an oblique direction to the lower side $\mathbf{20}_L$ of the flexible insulator film member 20.

What is claimed is:

1. An electromagnetic coupling type four-point feeding loop antenna comprising:

a tubular body formed by rounding a flexible insulator film member around a central axis in a tubular fashion, said tubular body having a peripheral surface;

a loop portion made of a conductor, said loop portion being formed on said tubular body along said peripheral surface around said central axis in a loop fashion, said loop portion having a loop width;

four feeders formed on the peripheral surface of said tubular body to feed to said loop portion at four points, each of said four feeders having a feeder width; and four electromagnetic coupling wires, connected to said loop portion, extending on said flexible insulator film member from said loop portion along said four feeders with gaps left between said four feeders and said four electromagnetic coupling wires, respectively, each of said four electromagnetic coupling wires having a coupling wire width, wherein said loop width, said feeder width, and said coupling wire width are substantially equal to one another and each of said gaps is laid in a range between 0.2 mm and 0.8 mm, both inclusive, when said electromagnetic coupling type four-point feeding loop antenna has a feeding impedance of a range between 25 Ω and 100 Ω, both inclusive.

2. An electromagnetic coupling type four-point feeding loop antenna as claimed in claim 1, wherein:

said flexible insulator film member has a substantially rectangular shape having an upper side, a lower side, a first lateral side, and a second lateral side, said tubular body is formed by connecting said first lateral side with said second lateral side, said loop portion is formed on one surface of said flexible insulator film member in a vicinity of the upper side, and each of said four feeders extends on said flexible insulator film member from said lower side to a vicinity of said loop portion.

3. An electromagnetic coupling type four-point feeding loop antenna as claimed in claim 2, wherein each of said loop width, said feeder width, and said coupling wire width is equal to 1 mm, each of said gaps is equal to 0.4 mm, an interval between said loop portion and said lower side is equal to 20 mm, an interval between said lower side and a tip of each of said four electromagnetic coupling wires is equal to 9 mm, and each of said four feeders has a length of 15 mm when said feeding impedance is equal to 25 Ω.

4. An electromagnetic coupling type four-point feeding loop antenna as claimed in claim 2, wherein each of said loop width, said feeder width, and said coupling wire width is equal to 1 mm, each of said gaps is equal to 0.4 mm, an interval between said loop portion and said lower side is equal to 20 mm, an interval between said lower side and a tip of each of said four electromagnetic coupling wires is equal to 5 mm, and each of said four feeders has a length of 12 mm when said feeding impedance is equal to 50 Ω.

5. An electromagnetic coupling type four-point feeding loop antenna as claimed in claim 2, wherein each of said loop width, said feeder width, and said coupling wire width is equal to 1 mm, each of said gaps is equal to 0.4 mm, an interval between said loop portion and said lower side is equal to 20 mm, an interval between said lower side and a tip of each of said four electromagnetic coupling wires is equal to 3 mm, and each of said four feeders has a length of 8 mm when said feeding impedance is equal to 100 Ω.

6. An antenna unit comprising:

a satellite wave antenna for receiving a satellite wave;

a terrestrial wave antenna for receiving a terrestrial wave;

a shield case on which said satellite wave antenna and said terrestrial wave antenna are mounted;

a top cover and a bottom cover for covering said satellite wave antenna, said terrestrial wave antenna, and said shield case; and a twin cable connected to said shield case through a bushing sandwiched between said top cover and said bottom cover, said twin cable comprising a first cable for said satellite wave antenna and a second cable for said terrestrial wave antenna, said first and said second cables having first and second outer coats, respectively, and at least one of said first and said second outer coats having a marking formed thereon to distinguish between said first cable and said second cable.

7. An antenna unit as claimed in claim 6, wherein said satellite wave antenna comprises a loop antenna, and said terrestrial wave antenna comprises a monopole antenna.

8. An antenna unit as claimed in claim 6, wherein said marking has a color different from a color of said first and said second outer coats.

9. An antenna unit as claimed in claim 8, wherein said marking is formed on said first and said second outer coats, and the marking for said first outer coat and the marking for said second outer coat have different colors.

* * * * *